US006422564B1

(12) United States Patent
Baranauskas

(10) Patent No.: US 6,422,564 B1
(45) Date of Patent: Jul. 23, 2002

(54) METHOD AND APPARATUS FOR PLAYING A WAGERING GAME

(76) Inventor: Alfons V. Baranauskas, 9956 Johnny Cake Rd., Unit M-10, Concord, OH (US) 44077

( * ) Notice: Subject to any disclaimer, the term of this patent is extended or adjusted under 35 U.S.C. 154(b) by 0 days.

(21) Appl. No.: 09/522,048

(22) Filed: Mar. 9, 2000

Related U.S. Application Data

(60) Provisional application No. 60/123,462, filed on Mar. 9, 1999, provisional application No. 60/123,460, filed on Mar. 9, 1999, provisional application No. 60/123,478, filed on Mar. 9, 1999, provisional application No. 60/123,466, filed on Mar. 9, 1999, provisional application No. 60/123,467, filed on Mar. 9, 1999, and provisional application No. 60/131,032, filed on Apr. 26, 1999.

(51) Int. Cl.[7] ..... A63F 1/00

(52) U.S. Cl. ..... 273/292; 273/274; 273/303; 273/305; 463/26; 463/27

(58) Field of Search ..... 273/236, 292, 273/306, 274, 303, 305; 463/26, 27, 13

(56) References Cited

U.S. PATENT DOCUMENTS

| | | | |
|---|---|---|---|
| 3,667,757 | A | 6/1972 | Holmberg |
| 5,072,946 | A | 12/1991 | Miller |
| 5,098,107 | A | 3/1992 | Boylan et al. |
| 5,174,579 | A | 12/1992 | Griffiths |
| 5,226,661 | A | 7/1993 | Wolf |
| 5,288,081 | A | 2/1994 | Breeding |
| 5,314,193 | A | 5/1994 | Ferrer |
| 5,454,570 | A | 10/1995 | Karal |
| 5,713,574 | A | 2/1998 | Hughes |
| 5,851,011 | A | 12/1998 | Lott |
| 5,975,529 | A | 11/1999 | de Keller |
| 6,065,753 | A | 5/2000 | Morosky |
| 6,079,713 | A | 6/2000 | Paz |
| 6,279,910 | B1 | 8/2001 | de Keller |

OTHER PUBLICATIONS

Alfons V. Baranauskas; Triptease; Mar. 9, 1998 (effective date of copyright registration); TXu 843–395.

Alfons V. Baranauskas; Forty–Niner; Mar. 9, 1998 (effective date of copyright registration); TXu 843–393.

Alfons V. Baranauskas; Wagering Card Game; Mar. 9, 1998 (effective date of copyright registration); TXu 843–411.

Alfons V. Baranauskas; On The Money; Mar. 9, 1998 (effective date of copyright registration); TXu 848–200.

Alfons V. Baranauskas; Birdie; Mar. 9, 1998 (effective date of copyright registration); TXu 843–394.

Alfons V. Baranauskas; Trio; Jul. 15, 1999 (date received by Copyright Office).

Alfons V. Baranauskas; Match; Jul. 15, 1999 (date received by Copyright Office).

Alfons V. Baranauskas; Midway; Jul. 15, 1999 (date received by Copyright Office).

Alfons V. Baranauskas; Split; Jul. 15, 1999 (date received by Copyright Office).

Alfons V. Baranauskas; Niner; Jul. 15, 1999 (date received by Copyright Office).

*Primary Examiner*—Benjamin H. Layno
*Assistant Examiner*—Dolores R Collins
(74) *Attorney, Agent, or Firm*—Renner, Otto, Boisselle & Sklar, LLP

(57) ABSTRACT

A playing card wagering game method which involves each player making a wager. A dealer deals cards face down to each participating player. Players discard the highest numerical ranking card of their dealt cards and place said card into an appropriate high card area. Players then hold two of the remaining four cards, discarding the two remainder cards into an appropriate discard area. Dealer builds a dealer two card hand from the high cards discarded from the players. All cards in each players hand are shown and the payouts and collections are resolved according to summed numerical values of each players and the dealers two card hand. The ones position of the summed numerical value is to determine the scores of the respective players and dealer. A winning score is less in numerical value than a losing score.

30 Claims, 7 Drawing Sheets

METHOD AND APPARATUS FOR PLAYING A WAGERING GAME

CLAIM OF PRIORITY

This application claims priority based on provisional patent applications Ser. No. 60/123,462, filed Mar. 9, 1999; Ser. No. 60/123,460, filed Mar. 9, 1999; Ser. No. 60/123,478, filed Mar. 9, 1999; Ser. No. 60/123,466, filed Mar. 9, 1999; Ser. No. 60/131,032, filed Apr. 26, 1999; and Ser. No. 60/123,467, filed Mar. 9, 1999. All of the aforesaid applications are hereby incorporated herein by reference.

TECHNICAL FIELD

The present invention relates to a playing card wagering game that can be played with the lower numerical ranking portion of a typical fifty-two card deck of Poker playing cards, said portion comprising the card ranks of, for example Two through Eight, or Two through Seven, or the game can be played by video machine technology in a casino or home environment. In particular, it relates to a method and apparatus for playing a wagering game, wherein the game is not a variation of typical Poker or Baccarat game play and provides players with a game that is uncomplicated and exciting.

BACKGROUND

There are many wagering games used for betting or chancing. Such games should be exciting to arouse players interest and uncomplicated so they can be understood easily by a large quantity of players. Ideally, the games should be able to be played swiftly to a wager resolving outcome. Wagering games, particularly those intended primarily for play in casinos should provide players with a sense of participation and control, the opportunity to make more than one wagering decision, and reasonable odds of winning even though the odds favor the casino, house, dealer or banker. The game must also accommodate the requirements of regulatory agencies.

SUMMARY OF THE PRESENT INVENTION

According to an embodiment of the present invention, a wagering game of the present invention may be played with a lower numerical ranking portion, said portion comprising the card ranks of Two through Eight of a typical fifty-two card Poker deck or a conglomeration of multiple said portions. Card ranks of Nine through Ace need not be used in the present invention and said game does not involve the generally well recognized and accepted set of rules and procedures of typical Poker or Baccarat game play. The game method comprises of each player placing an initial wager to participate in the game. Five cards are dealt to each player position by the dealer. Players inspect their cards and said players must discard the highest numerical ranking card in their hand and place said card into an appropriate depicted high card area in front of that player position. If player positions are not occupied, the dealer retrieves the highest numerical ranking card from said positions and places said card into the appropriate said high card area in front of that unoccupied player position. Next players decide what two cards of their remaining four cards they wish to hold and build their mandatory two card hand with. Players must place said two cards into an appropriate depicted hold card area in front of that player position. Players must then discard the remainder two cards into an appropriate depicted discard area in front of that player position. Each player then has the benefit of a two card hand. Next the dealer chooses the houses two card hand from the high card each player position discarded into the high card area for that player position. The dealer indicates said choices by placing an indicator apparatus onto each of the two cards chosen. Dealer queries the players of the houses two card hand. Finally all cards in each occupied player positions are shown, and the payouts to the winning hands and the collections of the losing hands wagers are resolved. The players are playing against the dealer and not against each other.

Specifically, the participating players initial wager is a one part wager and is placed before any cards are dealt by the dealer. Each player position is dealt a total of five cards face down in the customary fashion regardless if said position is occupied with a participating player. Next each player inspects their cards and must discard the highest numerical ranking card of their five initial cards, said high card is common to the dealers two card hand. Players must place said high card into the appropriate high card area in front of that player position depicted by the word HIGH on the gaming table top. If player positions are unoccupied, the dealer retrieves the numerically highest ranking card from each said positions hand and said dealer places said card into the appropriate HIGH card area in front of said unoccupied positions on the gaming table top. Next the players must build their two card hand from the four remaining cards in their hand. Players select said two cards for their summed numerical value and for representing their competing two card hand. Players place said two cards face down into the hold card receiving area depicted by the word HOLD in front of that player position. Said players place the remainder two cards face up into the discard area depicted by the word DISCARD in front of that player position. Next the dealer selects the houses two card hand by placing a removable indicator apparatus onto two of the five single high cards that were discarded by each player position. Said selections represent the dealers mandatory two card hand, and remain in the depicted high card areas in front of each player position on the gaming table top. Each player and the dealer then have the benefit of a two card hand. Said two card choices by each player and by the dealer are on the basis of keeping their two card summed totals as low as possible, as in a typical Golf game scoring method, wherein a winning score is less in value than a losing score. Said method is unique to the present invention on the basis of each player having four cards numerical values with which to build their two card hands low score, and the dealer having five cards numerical values with which to build said dealers two card hands low score. After summing the two cards numerical values of each participating players two card hand and after summing the two cards numerical value of the dealers two card hand the tens position is dropped or eliminated to give the competing two card score (as for example in Baccarat). Only the ones position value is honored in the present invention. Next the dealer announces the houses two card summed score. The dealer then using one and/or two enlarged playing dice, displays or shows the summed value of the houses two card score. When the dealers two card hand total score equals one through six, the dealer indicates said score using only one said playing die. If the dealers two cards summed score equals eleven through sixteen, then the tens position would be dropped, scoring said sums as one through six and the dealer indicates said score using one said playing dice. If said summed score equals ten, then the dealer announces zero for said score. If the dealers two card summed score equals seven, eight or nine then the dealer would use both said playing dice to indicate the houses two card score. Dealer inspects each occupied player positions two card discard and inspects their two card hand to assure that each player did discard their highest numerical ranking card into the high card area for that player position. Dealer then calculates each participating players two card hands score as in the same manner or method mentioned above regarding dropping the tens position and said dealer determines what payout, if any, each player is entitled to receive according to that players initial wager and the payout schedule for that house or casino.

Apparatus is disclosed for playing the wagering game according to the method outlined above. A typical gaming table with a playing surface includes specific areas that provide locations for each player position and areas for placing the players wagers, an area for receiving and displaying the players high cards, an area for receiving and displaying the players hold cards, and an area for receiving and displaying the players discards and an area for displaying the inventors company initials and copyright information. A card shuffling machine, such as that disclosed in U.S. Pat No. 4,807,884 for facilitating and speeding the play of the wagering game maybe used but is not necessary in the present invention.

According to another embodiment of the present invention, a wagering game of the present invention may be played with a lower numerical ranking portion, said portion comprising the card ranks of Two through Seven of a typical fifty-two card Poker deck or a conglomeration of multiple said portions. Card ranks of Eight through Ace need not be used in the present invention and said game does not involve the generally well recognized and accepted set of rules and procedures of typical Poker or Baccarat game play. The game method comprises of each player placing an initial wager to participate in the game. Five cards are dealt to each player position by the dealer. Players inspect their cards and said players must discard the highest numerical ranking card in their hand and place said card into an appropriate depicted high card area in front of that player position. If player positions are not occupied, the dealer retrieves the highest numerical ranking card from said positions and places said card into the appropriate said high card area in front of that unoccupied player position. Next players decide what one or what two cards of their remaining four cards they wish to hold and build their mandatory one or two card hand with. Players must place said one or said two cards into an appropriate depicted hold card area in front of that player position. Players must then discard the remainder two or remainder three cards into the appropriate depicted discard area in front of that player position. Each player then has the benefit of a one or of a two card hand. Next the dealer chooses the houses mandatory two card hand from the high card each player position discarded into the high card area for that player position. The dealer indicates said choices by placing an indicator apparatus onto each of the two said cards chosen. Dealer queries the players of the houses two card hand. Finally all cards in each occupied player positions are shown, and the payouts to the winning hands and the collections of the losing hands wagers are resolved. The players are playing against the dealer and not against each other.

Specifically, the participating players initial wager is a one part wager and is placed in either of the two distinct wager areas for that player position before any cards are dealt by the dealer. That is, if players want to wager on just holding one of their four remaining cards then that player would place a bet at a one card distinct wager area, If players want to wager on holding two cards to compete against the dealer hands score then that player would place a wager at a two-card distinct wager area. Each player position is dealt a total of five cards face down in the customary fashion regardless if said position is occupied with a participating player. Next each player inspects their cards and must discard the highest numerical ranking card of their five initial cards, said high card is common to the dealers two card hand. Players must place said high card into the appropriate high card area in front of that player position depicted by the word HIGH on the gaming table top. If player positions are unoccupied, the dealer retrieves the numerically highest ranking card from each said positions hand and said dealer places said card into the appropriate HIGH card area in front of said unoccupied positions on the gaming table top. Next the players must build their one or two card hand from the four remaining cards in their hand. Players select said one or said two cards for their numerical or summed numerical value and for representing their competing one or two card hand. Players place said one or said two cards face down into the hold card receiving area depicted by the word HOLD in front of that player position. Said players place the remainder one or remainder two cards face up into the discard area depicted by the word FOLD in front of that player position. Next the dealer selects the houses two card hand by placing a removable indicator apparatus onto two of the seven single high cards that were discarded by each player position. Said selections represent the dealers mandatory two card hand, and remain in the depicted high card areas in front of each player position on the gaming table top. Each player now has the benefit of a one or of a two card hand and the dealer now has the benefit of a two card hand. Said card choices by each player and by the dealer are on the basis of keeping their card or cards summed totals as low as possible, as in a typical Golf game scoring method, wherein a winning score is less in value than a losing score. Said method is unique to the present invention on the basis of each player having four cards numerical values with which to build their one or two card hands low score, and the dealer having seven cards numerical values with which to build said dealers two card hands low score. After summing the one or two cards numerical values of each participating players two card hand and after summing the two cards numerical value of the dealers two card hand the tens position is dropped or eliminated to give the competing one or two card score, as for example in Baccarat. Only the ones position value is honored in the present invention. Next the dealer announces the houses two card summed score. The dealer then using one and/or two enlarged playing dice, displays or shows the summed value of the houses two card score. When the dealers two card hand total score equals one through six, the dealer indicates said score using only one said playing die. If the dealers two cards summed score equals eleven through sixteen, then the tens position would be dropped, scoring said sums as one through six and the dealer indicates said score using one said playing dice. If said summed score equals ten, then the dealer announces zero for said score. If the dealers two card summed score equals seven, eight or nine then the dealer would use both said playing dice to indicate the houses two card score. Dealer inspects each occupied player positions two to three card discard and inspects their one to two card hand to assure that each player did discard their highest numerical ranking card into the high card area for that player position. Dealer then calculates each participating players one or two card hands score as in the same manner or method mentioned above regarding dropping the tens position and said dealer determines what payout, if any, each player is entitled to receive according to that players initial wager and the payout schedule for that house or casino.

Apparatus is disclosed for playing the wagering game according to the method outlined above. A typical gaming table with a playing surface includes specific areas that provide locations for each player position and areas for placing the players wagers, an area for receiving and displaying the players high cards, an area for receiving and displaying the players hold cards, and an area for receiving and displaying the players folded cards and an area for displaying the inventors company initials and copyright information. A card shuffling machine, such as that disclosed in U.S. Pat No. 4,807,884 for facilitating and speeding the play of the wagering game maybe used but is not necessary in the present invention.

It is an aim of the present invention to provide a simple and interesting wagering game that is easy to learn on the basis of said games scoring method is related to the common game of Golf.

It is an aim of the present invention to provide a new wagering card game which is made interesting by providing the opportunity for each player to build their own two card hand along with building the dealer or houses two card hand from five initial cards.

It is another aim of the present invention to provide a unique and exciting card game for play in casinos or at home and on various media including casino tables and or video machines.

DESCRIPTION OF THE DIAGRAMS

DETAILED DESCRIPTION OF THE PREFERRED EMBODIMENT

Figure 1:
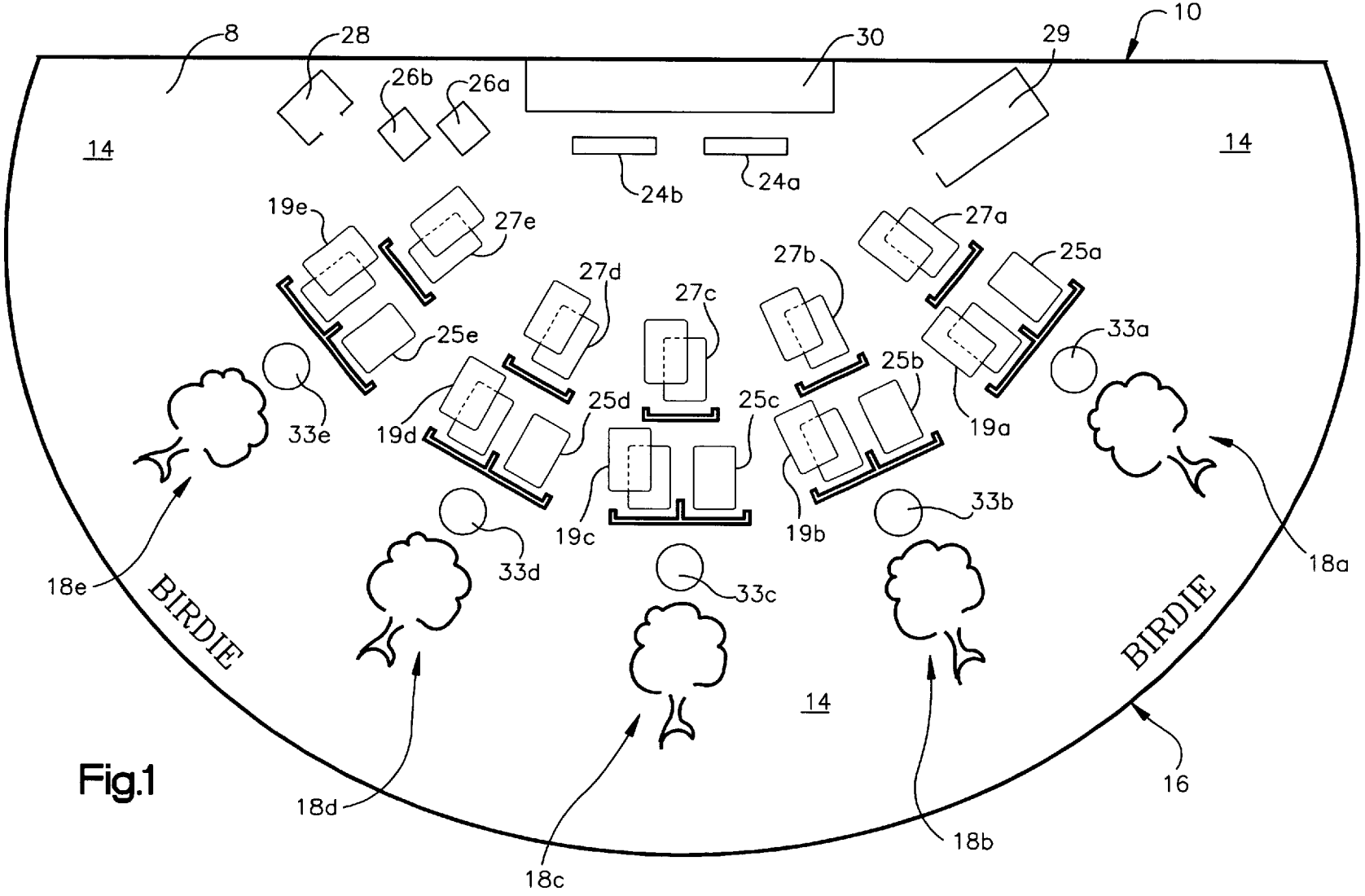
FIG. 1 depicts a table top layout and apparatus used in playing a wagering game in accordance with an embodiment of the present invention.

Referring to FIG. 1, an apparatus for a wagering game in accordance with an embodiment of the present invention includes a typical casino gaming, half sphere in geometric shape table 8. The table 8 has a curved side 16 for accommodating up to five players and a straight side 10 for accommodating the dealer 30. The table 8 has a flat surface 14 covered with cloth, felt or other appropriate material. A house dealer position 30 is also provided. Although five playing positions or locations 18*a–e* (exch being depicted by a single tree or other appropriate image) are provided, it is not essential to the game that exactly five persons play, however it is essential to game play of the present invention that no greater than five persons 18*a–e* play for said game play to be fair for both the dealer 30 and for the players 18*a–e*. Said maximum of five player positions 18*a–e* provides for a maximum of five high card discards 25*a–e* for the dealer to build the houses two card hand 24*a–b* from, and to provide a fairness to the players on the basis of all participating players receiving the same amount of initial cards as the dealer to build their two card hands 19*a–e* score from, which is essential to the game of the present invention. Also it provides for a game that is easily manageable by the dealer or house 30. In front of the dealer position 30 are two indicator apparatus' 24*a–b* for the dealer to place onto two of the high card discards from the player positions 18*a–e*. Each player position 18*a–e*includes a non specific card area depicted by a single tree or other appropriate image for receiving cards dealt to the player occupying that position. In front of said areas 18*a–e* are wagering areas 33*a–e*. These areas 33*a–e* are designed to receive appropriate wagering settling means such as coins or chips (not shown). In front of each player positions wagering areas 33*a–e* are card receiving areas 25*a–e* for receiving and displaying the high card discard from each player position. Also next to areas 25*a–e* is a card hold area 19*a–e* for receiving and displaying the players two card hand. Also in front of said areas is a discard area 27*a–e* for receiving and displaying each participating players two card discards. At one side of the dealer position 30, the apparatus for holding the cards or conglomeration of multiple card portions rests unmounted on the table top 14, and might be of a typical card shoe 29 or similar open ended box for dispensing cards face down. At one side of the dealer position 30 the apparatus for receiving used cards and discards might be of a raised three wall type open ended plastic box 28. Said apparatus' 8, 24*a–b*, 26*a–b*, 28 and 29 are provided by the house or casinos.

Figure 2:
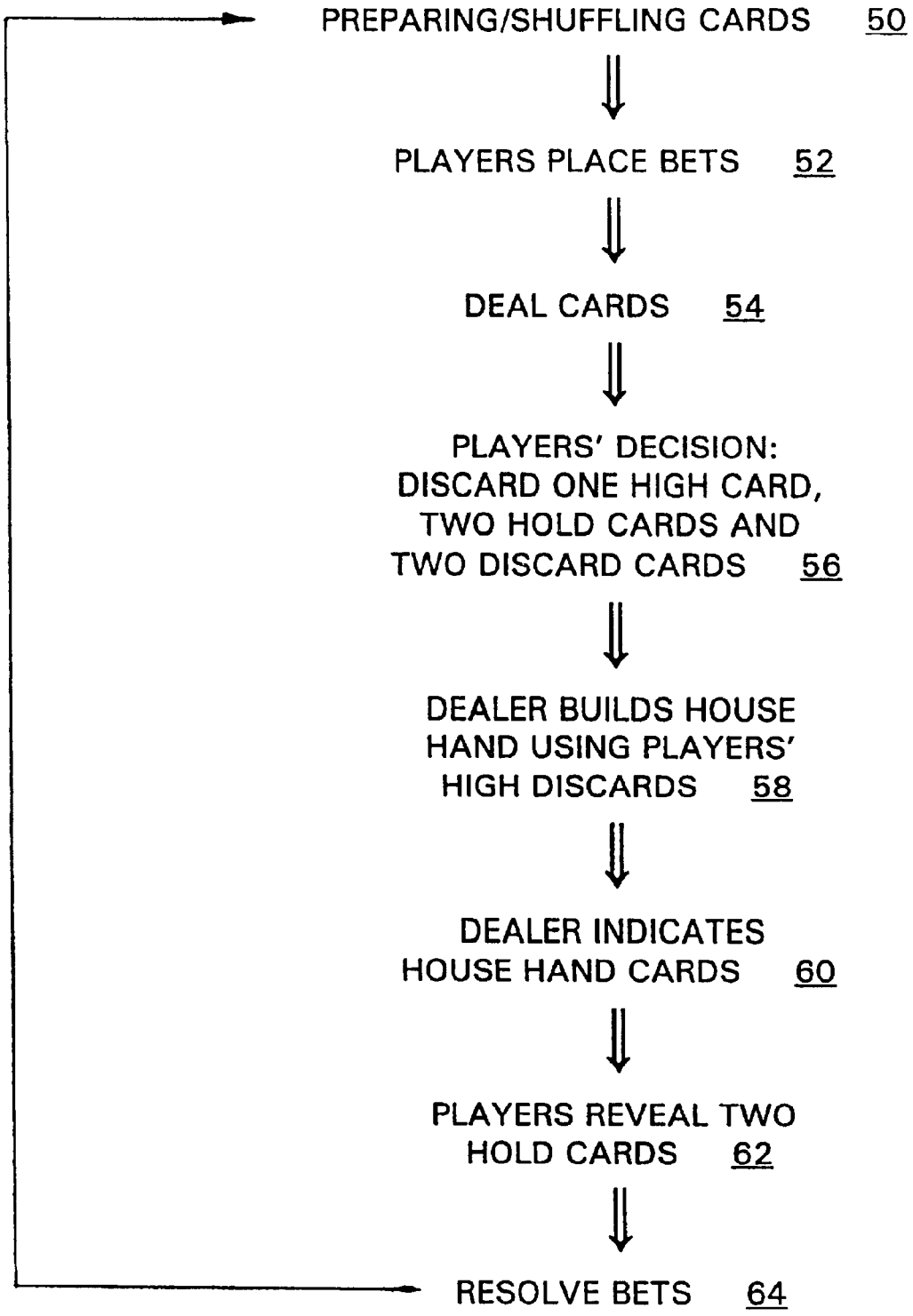
FIG. 2 is a Flow diagram representing the flow of play in said FIG. 1 game.

Referring to the Flow diagram of FIG. 2, the initial step in playing the game of the present invention is preparing and shuffling the lower ranking portion, said portion comprising the card ranks of Two through Eight of a typical fifty-two card Poker deck or conglomeration of multiple said portions Flow 50. Hand shuffling by the dealer 30 is used to prepare said cards. Next the players place an initial one part wager Flow 52 by physically placing said wager amount into the appropriate wagering area 33*a–e* in front of that player position 18*a–e*. After the participating players are content with their wagers the cards are dealt by the dealer Flow 54. Each player position is dealt five cards face down regardless if said position 18*a–e* is occupied with a player. Of course, the order in which the cards are initially dealt may differ as desired. For example, the player positions may receive cards one at a time in succession to each player position until all player positions each have five cards, or the player positions may receive cards five at a time in succession to each player position. Of course, other variations in the way the cards are dealt Flow 54 are also possible and such variations are contemplated as falling within the scope of the claimed invention. The players inspect their cards in preparation for reaching Flow 56. At decision Flow 56, the players must discard the highest numerical ranking card in that players hand and place said card face up into the high card area 25*a–e* in front of that player position 18*a–e*. If player position is unoccupied the dealer 30 only retrieves the high card from said positions hands and places said card into the appropriate high card area 25*a–e* in front of that player position 18*a–e* and said dealer 30 discards the remainder four cards 28. During decision Flow 56, the players also decide which two cards they will keep for their mandatory two card hand. Players place said two cards face down into the appropriate hold area 19*a–e* in front of that player position. Players then discard and place the remainder two cards face up into the discard area 27*a–e* in front of that player position 18*a–e*. Next the dealer builds the houses mandatory two card hand from the high card discard 25*a–e* in front of each of the five player positions 18*a–e* Flow 58. The dealer 30 chooses said two cards for their summed numerical values. The dealer then indicates said choices by placing two removable indicator apparatus' 24*a–b* onto two of the high cards 25*a–e* thereby giving the dealer or house 30 a two card hand. Each player now has the benefit of a two card hand 19*a–e*, and the dealer now has the benefit of a two card hand represented by 24*a–b*. The flow of the game proceeds to Flow 60, wherein the dealer using the basic method of addition sums the dealers two cards 24*a–b* and indicates said sum first verbally and then physically with two enlarged common playing dice 26*a–b* by showing as in displaying the numbers face up on the dice that correlates with the dealers two card 24*a–b* hands score. As in the common game of Baccarat, only the second numerical digit or ones position is regarded in the scoring method of the present invention. Thus, when the dealers two card hand totals: eleven, twelve, thirteen, fourteen, fifteen or sixteen, the dealer then using only one of the dice 26*a* would display the numbers of one, two, three, four, five or six to represent and correlate with the second digit of the dealers two card said sum score. If the dealers two card summed total equals ten, the dealer would verbally announce no score or zero for the houses two card score. If the dealers two card score equals seven, eight or nine the dealer would use both dice 26*a–b* to indicate said dealers score. The score of zero is automatically a losing score for either of both the participating players 18*a–e* and for the dealer hand 24*a–b*, on the basis of a score of one being the best possible score for either the players or dealers hand. The players two card hand 19*a–e* summed totals (discussed below) also would follow the same second digit is only recognized method outlined above regarding dropping the tens position from the summed score. Next the flow of the game proceeds to Flow 62, wherein the players show or reveal their two card hand 19*a–e*. Next the dealer views each players two card discards in the discard area 27*a–e* and said dealer views each players two card hold hand 19*a–e* to assure that each participating player 18*a–e* did discard their highest numerical ranking card during Flow 56. Players prepare for Flow 64. At Flow 64 the dealer resolves each players bet based on the sum of that players two card hand 19*a–e* compared against the dealers summed two card hand 24*a–b*. Winning sums are less in value than the losing sums. Thus, for example, a two card total sum of fourteen loses to a two card total sum of twelve, and a two card total sum of nine loses to a two card total sum of six because a total sum score of one is the best possible score and a total summed score of nine is the worst possible score. The dealer resolves each players bet 33*a–e* and determines what payout, if any, the player is entitled to receive. Said payouts are based on, for example, one for one odds or even money returns. Bets on non winning hands are collected by the dealer or house 30. The hand is then over and the Flow of the game returns to Flow 52, players place bets, unless the cards in the card shoe 29 are exhausted to an unplayable level wherein the flow of the game then returns to Flow 50, preparing and shuffling cards.

Figure 3:
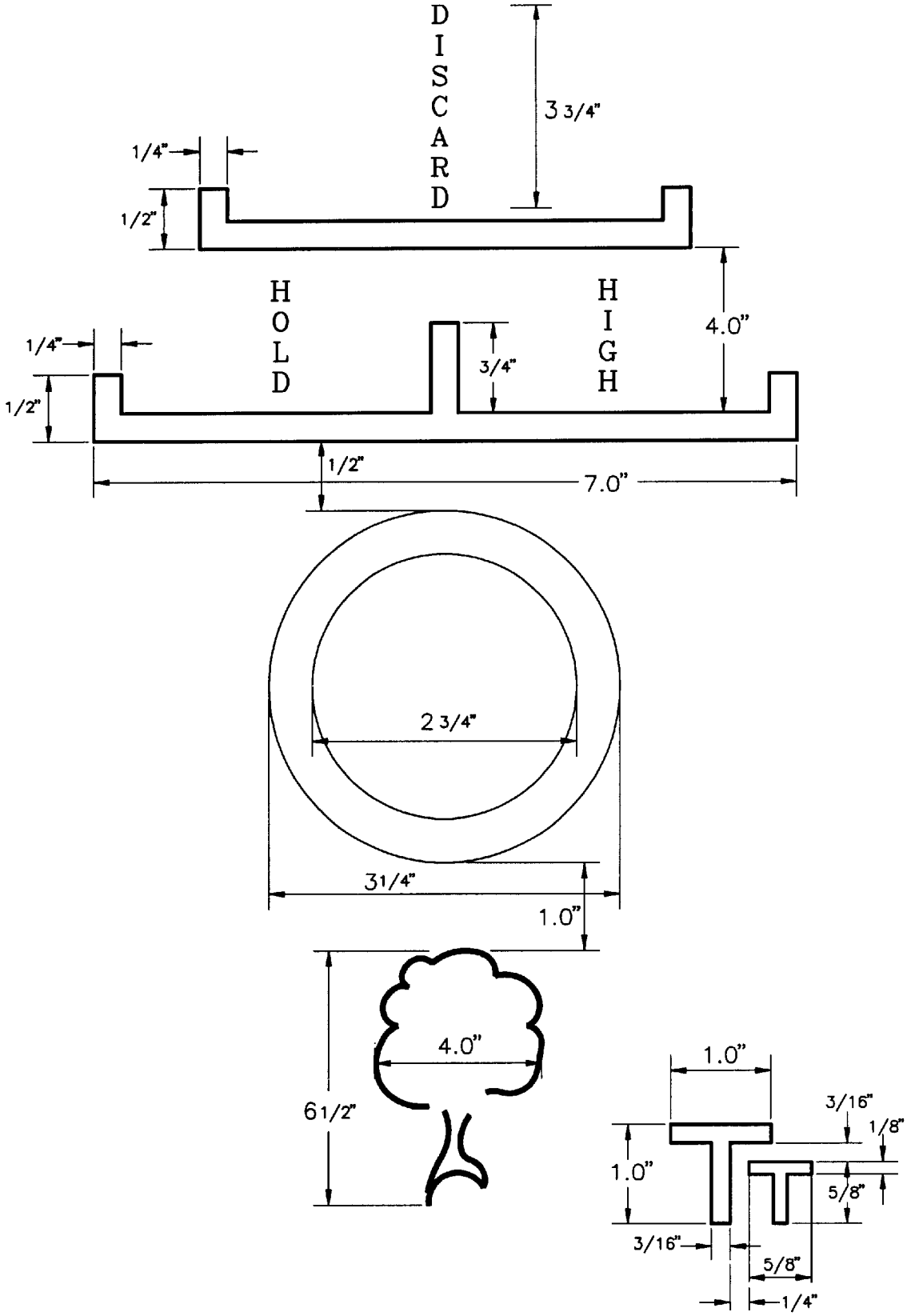
FIG. 3 depicts the actual dimensions of specific areas on a gaming table top in accordance with the present invention and for use in said FIG. 1 game.

Referring to FIG. 3, this is a diagram wherein the table top positions for the players wagers, players positions depicted by a single tree or other appropriate image, an area for the players high card, an area for the players discards, an area for the players hold cards and author of the present inventions abbreviated company name "TABLETOP TECHNOLOGY" (TT), are depicted in two dimensional view.

Figure 4:
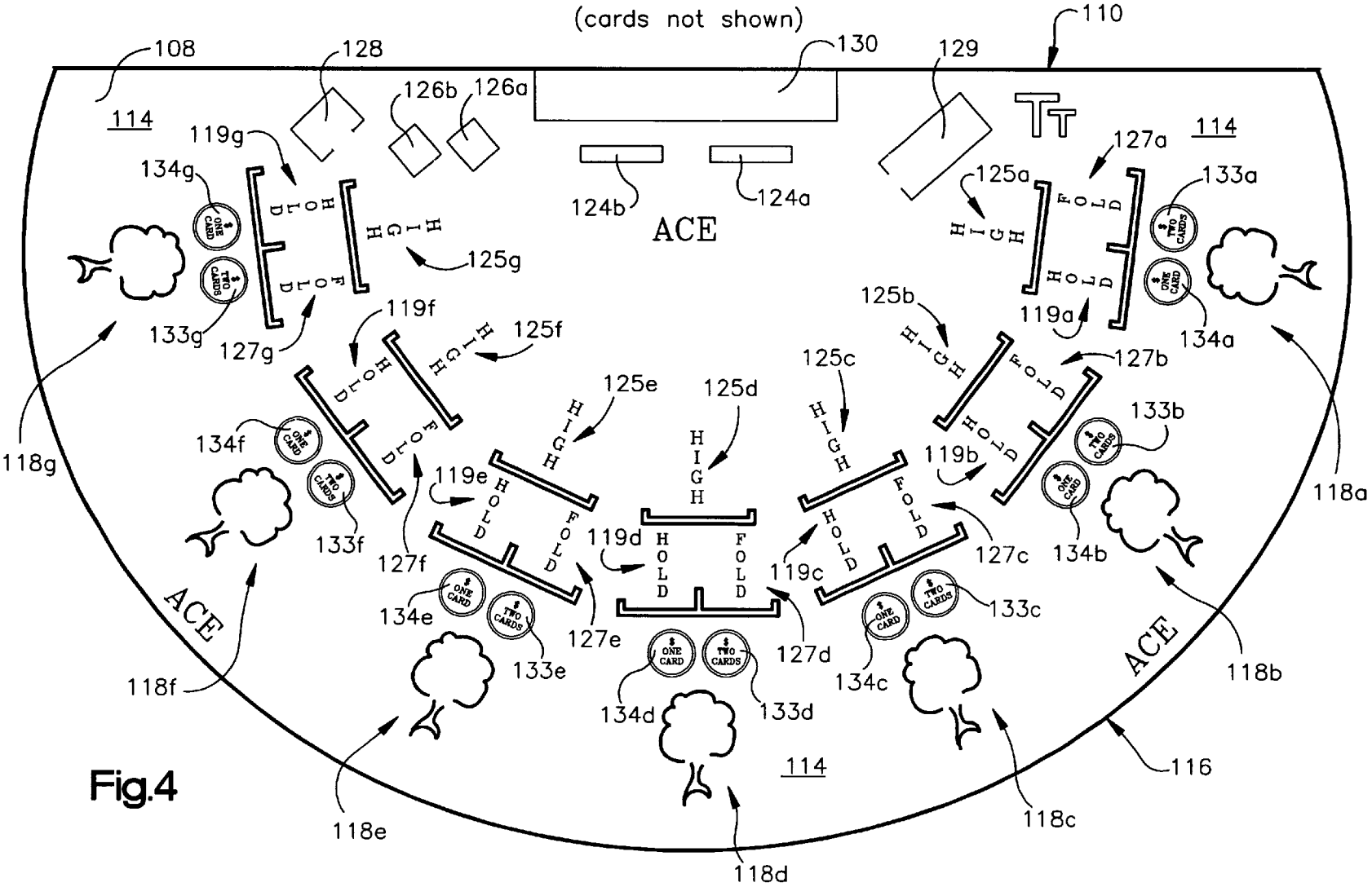
FIG. 4 depicts a table top layout and apparatus used in playing a wagering game in accordance with another embodiment of the present invention wherein cards are not shown.
Figure 5:
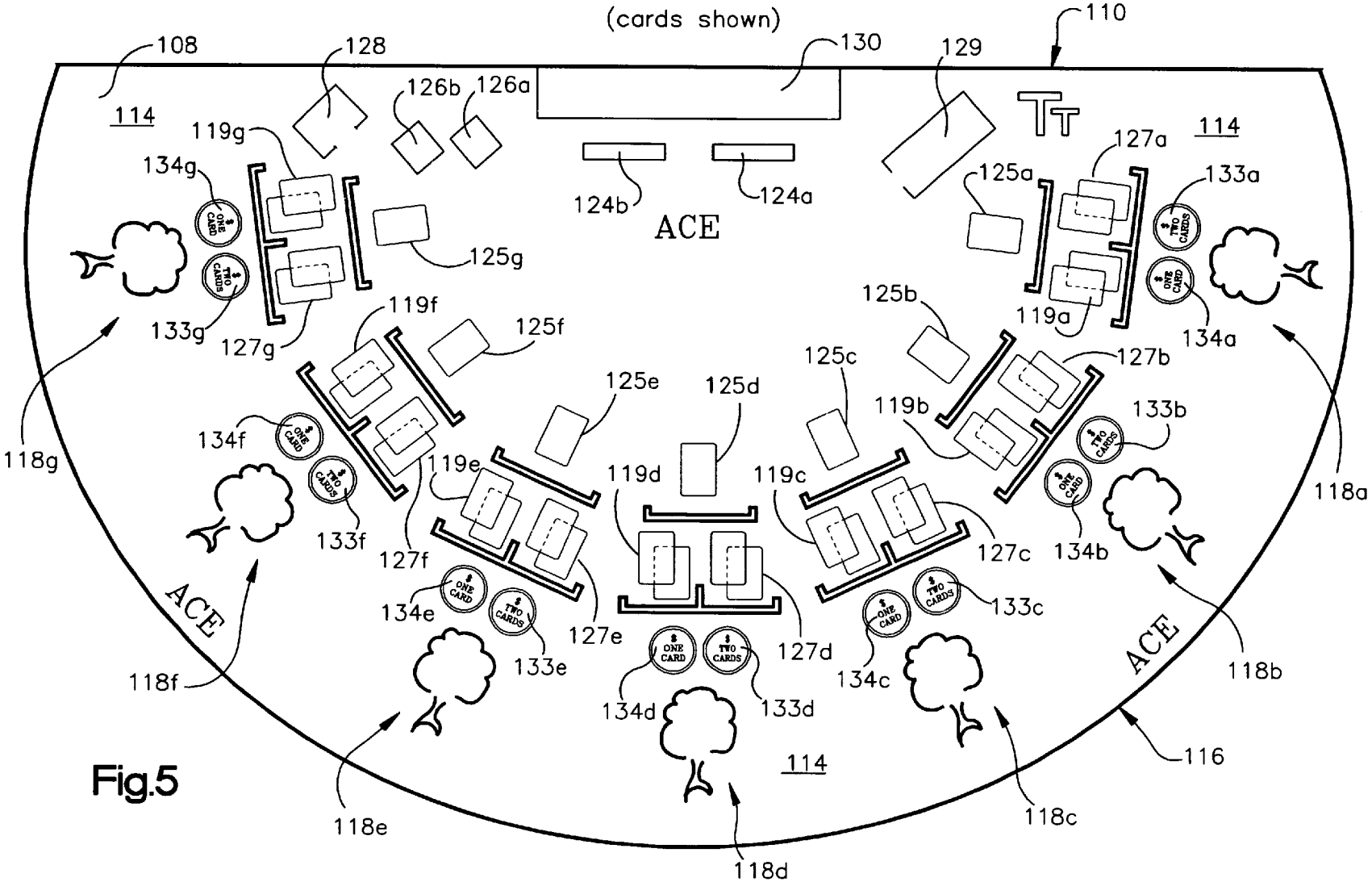
FIG. 5 depicts the table top layout and apparatus used in playing the wagering game depicted in FIG. 4 wherein cards are shown.

Referring now to FIGS. 4 and 5, an apparatus for a wagering game in accordance with another embodiment of the present invention includes a typical casino gaming, half sphere in geometric shape table 108. FIG. 4 shows the table wherein cards are not shown and FIG. 5 shows the table wherein cards are shown. The table 108 has a curved side 116 for accommodating up to aresevenare players and a straight side 110 for accommodating the dealer 130. The table 108 has a flat surface 114 covered with cloth, felt or other appropriate material. A house dealer position 130 is also provided. Although seven playing positions or locations 118*a–g* are (each being depicted by a single tree or other appropriate image) are provided, it is not essential to the game that exactly seven persons play, however it is essential to game play in accordance with the FIGS. 4 and 5 embodiment that no less or no greater than seven persons 118*a–g* play for said game play to be fair for both the dealer 130 and for the players 118*a–g*. Said minimum of seven player positions 118*a–g* provides for a minimum of seven high card discards 125*a–g* (described in greater detail below) for the dealer to build the houses two card hand 124*a–b* (described in greater detail below) from, and to provide a fairness to the house on the basis of all participating players receiving less than the same amount of initial cards as the dealer to build their one or two card hands 119*a–g* (described in greater detail below) score from, which is essential to the game of the FIGS. 4 and 5 embodiment. Also it provides for a game that is easily manageable by the dealer or house 130. In front of the dealer position 130 are two indicator apparatus' 124*a–b* for the dealer to place onto two of the high card discards from the player positions 118*a–g*. Each player position 118*a–g* includes a specific area depicted by a single tree or other appropriate image for receiving cards dealt to the player occupying that position. In front of said areas 118*a–g* are wagering areas 133*a–g* and areas 134*a–g*. These areas 133*a–g* and 134*a–g* are designed to receive appropriate wagering settling means such as coins or chips (not shown). In front of each player positions wagering areas 133*a–g* and 134*a–g*, are card receiving areas 125*a–g*, for receiving and displaying the high card discard from each player position. Also near to areas 125*a–g* is a card hold area 119*a–g* for receiving and displaying the players one or two card hand. Also near said areas is a fold discard area 127*a–g* for receiving and displaying each participating players two or three card discards. At one side of the dealer position 130, the apparatus for holding the cards or conglomeration of multiple card portions rests unmounted on the table top 114, and might be of a typical card shoe 129 or similar open ended box for dispensing cards face down. At one side of the dealer position 130 the apparatus for receiving used cards and discards might be of a raised three wall type open ended plastic box 128. Said apparatus'108, 124*a–b*, 26*a–b*, 128 and 129 are provided by the house or casinos.

Figure 6:
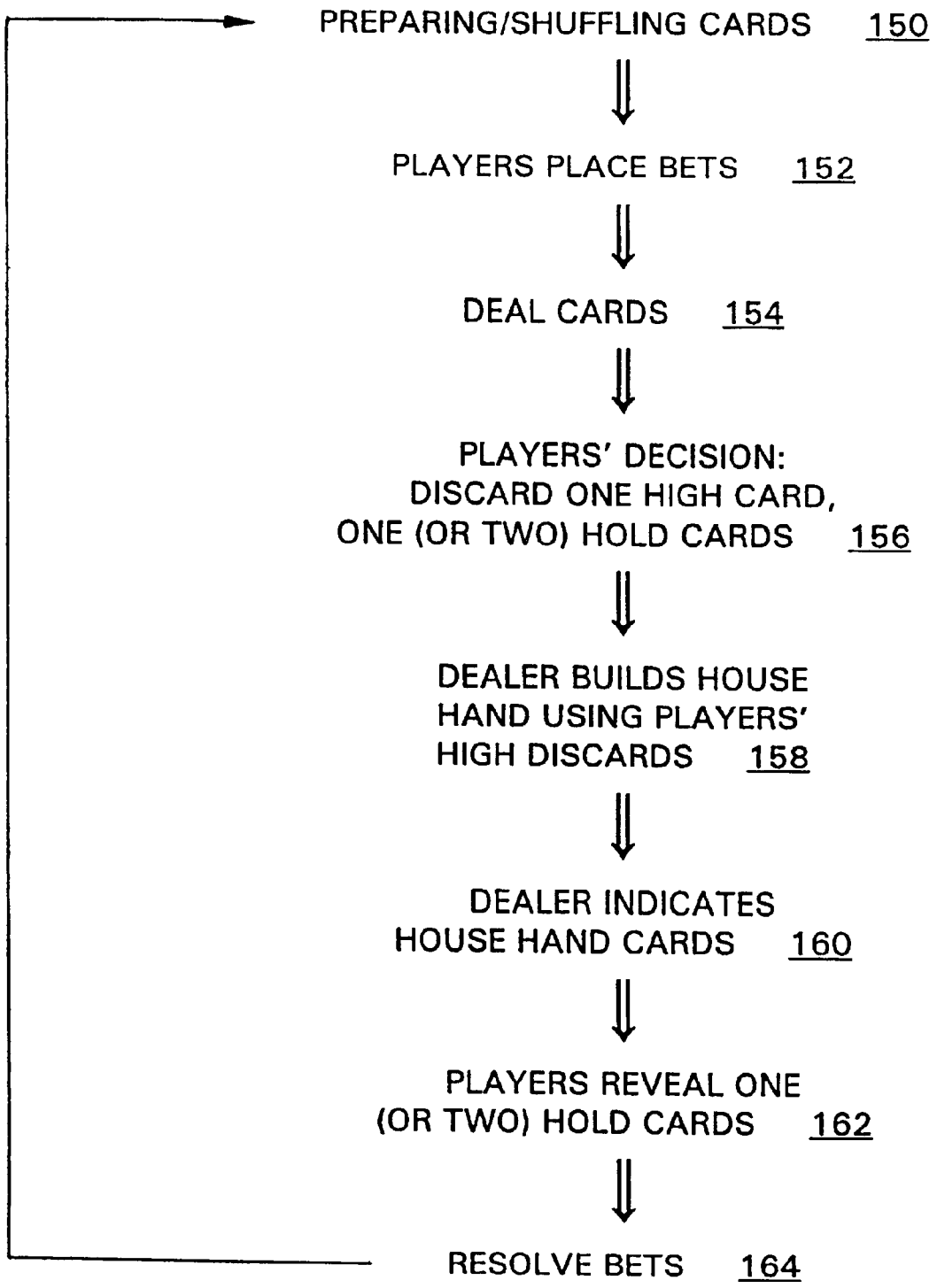
FIG. 6 is a Flow diagram representing the flow of play in said FIG. 4 game.

Referring to the Flow diagram of FIG. 6, the initial step in playing the game of the present invention is preparing and shuffling the lower ranking portion, said portion comprising the card ranks of Two through Seven of a typical fifty-two card Poker deck or conglomeration of multiple said portions Flow 150, the total quantity of playing cards in any event being at least 35. Hand shuffling by the dealer 130 is used to prepare said cards. Next the players place an initial one part wager Flow 152 by physically placing said wager amount into the appropriate wagering area 133*a–g* or 134*a–g* in front of that player position 118*a–g*. If a player 118*a–g* desires to wager on building a hand with one card of their remaining four cards (i.e., holding one of the remaining four cards after the high card is discarded, as described below) then that player would place a wager at wager area 134*a–g*, and if said player desires to wager on building a hand using two cards of their four remainder cards (i.e., holding two of the remaining four cards after the high card is discarded, as described below) then that player would place a wager at wager area 133*a–g*. After the participating players are content with their wagers the cards are dealt by the dealer Flow 154. Each player position is dealt five cards face down regardless if said position 118*a–g* is occupied with a player. Of course, the order in which the cards are initially dealt may differ as desired. For example, the player positions may receive cards one at a time in succession to each player position until all player positions each have five cards, or the player positions may receive cards five at a time in succession to each player position. Of course, other variations in the way the cards are dealt Flow 154 are also possible and such variations are contemplated as falling within the scope of the claimed invention. The players inspect their cards in preparation for reaching Flow 156. At decision Flow 156, the players must discard the highest numerical ranking card in that players hand and place said card face up into the high card area 125*a–g* in front of that player position 118*a–g*. If player position is unoccupied the dealer 130 only retrieves the high card from said positions hands and places said card into the appropriate high card area 125*a–g* in front of that player position 118*a–g* and said dealer 130 discards the remainder four cards 128. During decision Flow 156, the players also decide what one or what two cards they will keep for their mandatory one or two card hand. Players place said one or two cards face down into the appropriate hold area 119*a–g* in front of that player position. Players then discard and place the remainder two or three cards face up into the discard fold area 127*a–g* in front of that player position 118*a–g*. Next the dealer builds the houses mandatory two card hand from the seven high card discards 125*a–g* in front of each of the seven player positions 118*a–g* Flow 158. The dealer 130 chooses said two cards for their summed numerical values. The dealer then indicates said choices by placing two removable indicator apparatus' 124*a–b* onto two of the high cards 125*a–g* thereby giving the dealer or house 130 a two card hand. Each player now has the benefit of a one or two card hand 119*a–g*, and the dealer now has the benefit of a two card hand represented by 124*a–b*. The flow of the game proceeds to Flow 160, wherein the dealer using the basic method of addition sums the dealers two cards 124*a–b* and indicates said sum first verbally and then physically with two enlarged common playing dice 126*a–b* by showing as in displaying the numbers face up on the dice that correlates with the dealers two card 124*a–b* hands score. As in the common game of Baccarat, only the second numerical digit or ones position is regarded in the scoring method of the present invention. Thus, when the dealers two card hand totals: eleven, twelve, thirteen, fourteen, fifteen or sixteen, the dealer then using only one of the dice 126*a* would display the numbers of one, two, three, four, five or six to represent and correlate with the second digit of the dealers two card said sum score. If the dealers two card summed total equals ten, the dealer would verbally announce no score or zero for the houses two card score. If the dealers two card score equals seven, eight or nine the dealer would use both dice 126*a–b* to indicate said dealers score. The score of zero is automatically a losing score for either of both the participating players 118*a–g* and for the dealer hand 124*a–b*, on the basis of a score of one being the best possible score for either the players or dealers hand. The players one or two card hand 119*a–g* summed totals (discussed below) also would follow the same second digit is only recognized method outlined above regarding dropping the tens position from the summed score. Next the flow of the game proceeds to Flow 162, wherein the players show or reveal their one or two card hand 119*a–g*. Next the dealer views each players two or three card discards in the discard area 127*a–g* and said dealer views each players one or two card hold hand 119*a–g* to assure that each participating player 118*a–g* did discard their highest numerical ranking card during Flow 156. Players prepare for Flow 164. At Flow 164 the dealer resolves each players bet based on the sum of that players one or two card hand 119*a–g* compared against the dealers summed two card hand 124*a–b*. Winning sums are less in value than the losing sums. Thus, for example, a two card total sum of fourteen loses to a two card total sum of twelve, and a two card total sum of nine loses to a two card total sum of six because a total sum score of one is the best possible score and a total summed score of nine is the worst possible score. The dealer resolves each players bet 133*a–g*, 134*a–g* and determines what payout, if any, the player is entitled to receive. Said payouts are based on, for example, one for one odds or even money returns. Preferably, players having winning sum values using one card win wagers placed in the one card wager areas 134*a–g*, and players having winning sum values using two cards win wagers placed in the two card wager areas 133*a–g*. Bets on non winning hands are collected by the dealer or house 130. The hand is then over and the Flow of the game returns to Flow 152, players place bets, unless the cards in the card shoe 129 are exhausted to an unplayable level wherein the flow of the game then returns to Flow 150, preparing and shuffling cards.

Figure 7:
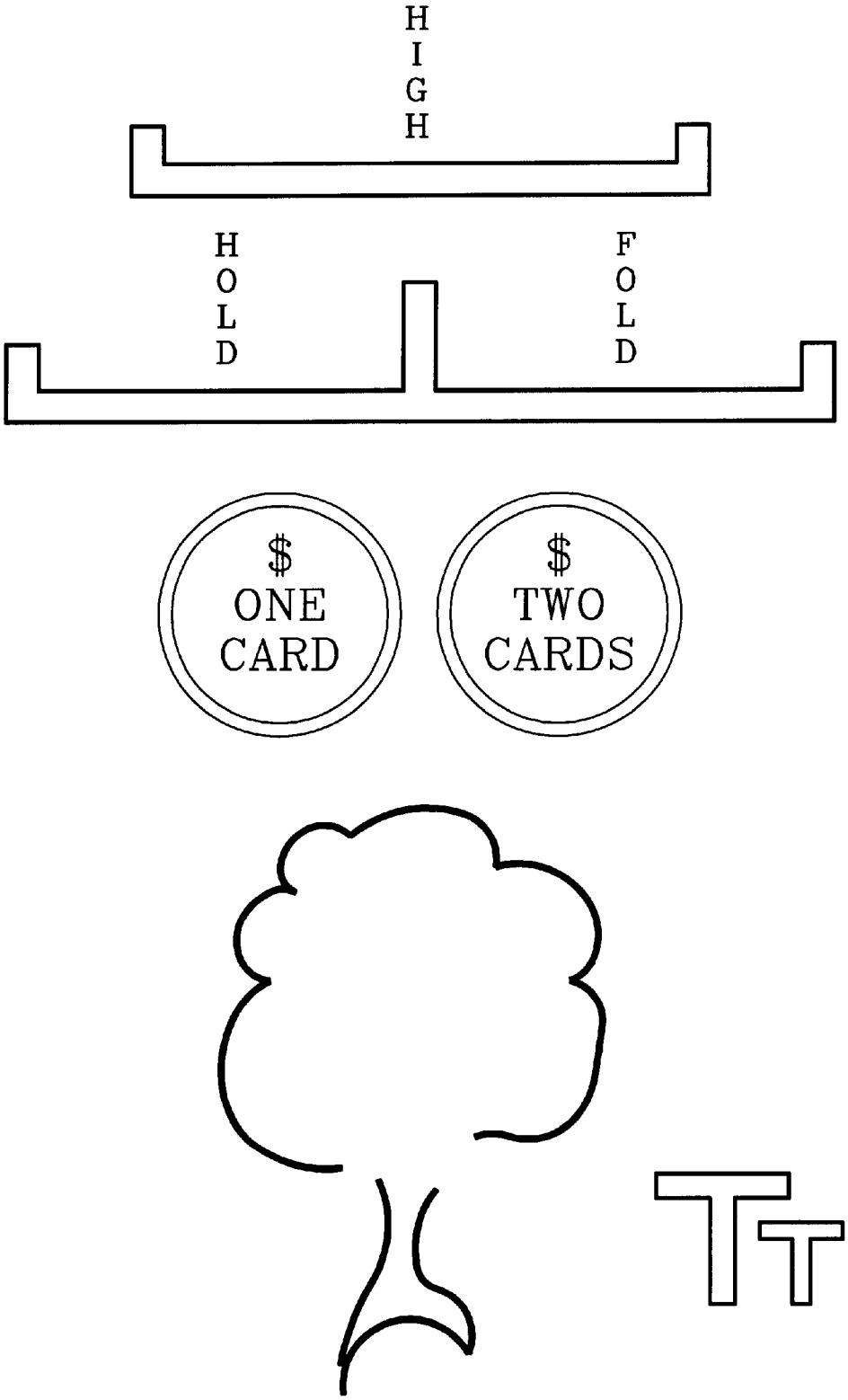
FIG. 7 depicts the actual dimensions of specific areas on a gaming table top in accordance with the present invention and for use in said FIG. 4 game.

Referring to FIG. 7, this is a diagram wherein the table top positions for the players wagers, players positions depicted by a single tree or other appropriate image, an area for the players high card, an area for the players fold discards, an area for the players hold cards and author of the present inventions abbreviated company name "TABLETOP TECHNOLOGY" (TT), are depicted in a two dimensional view.

The wagering game of the present invention might be played live in casinos with a dealer, or in casinos or homes in interactive electronic or video form with automatic coin or betting means receptacles and payout capabilities. The present invention may be embodied in other specific forms without departing from the essential attributes thereof. It is desired that the embodiments described above may be considered in all respects as illustrative, and not restrictive, reference being made to the appended claims.

According to an aspect of the invention, there is provided a method of playing a wagering card game for a number of players, comprising the steps of providing a plurality of numerically ranked cards, at least two of the numerically ranked cards having a different numerical ranking; each player placing a wager to participate in the game; dealing two or more cards face down to each player; giving each player an opportunity to examine the two or more cards dealt to that player; each player discarding face up the highest numerical ranking card and face down one or more hold cards from that players two or more dealt cards; determining a dealer score based on at least two or more of said players discarded face up highest numerical ranking cards; determining a player score for each player based on the players respective one or more discarded hold cards; and resolving each players wagers based on the dealers score and the players respective score.

What is claimed is:

1. A method of playing a wagering card game for a number of players, comprising the steps of:

providing a plurality of numerically ranked cards, at least two of the numerically ranked cards having a different numerical ranking;

each player placing a wager to participate in the game;

dealing two or more cards face down to each player;

giving each player an opportunity to examine the two or more cards dealt to that player;

each player discarding face up the highest numerical ranking card and face down one or more hold cards from that players two or more dealt cards;

determining a dealer score based on at least two or more of said players discarded face up highest numerical ranking cards;

determining a player score for each player based on the players respective one or more discarded hold cards; and resolving each players wagers based on the dealers score and the players respective score.

2. The method according to claim 1, wherein said plurality of numerically ranked cards comprises the card ranks of Two through Seven of a typical fifty-two card poker deck.

3. The method according to claim 1, wherein said plurality of numerically ranked cards comprises the card ranks of Two through Eight of a typical fifty-two card poker deck.

4. The method according to claim 1, wherein said plurality of numerically ranked cards comprises at least thirty five cards.

5. The method according to claim 1, wherein said plurality of numerically ranked cards comprises a plurality of lower numerically ranked cards of one or more typical fifty two card Poker decks.

6. The method according to claim 1, wherein said two or more cards dealt to each player are dealt to player positions occupied by the respective players and to player positions not occupied by the players.

7. The method according to claim 6, wherein a dealer discards face up the highest numerical ranking card from the cards dealt to the player positions not occupied by the players and the dealer score is based on said at least two of said players highest numerical ranking cards and said non occupied player position highest numerical ranking cards.

8. The method according to claim 1, wherein a quantity of players wager opportunities is equal to a quantity of players discards common to the dealers score.

9. The method according to claim 1, wherein the number of participating players is less than the players discarded face up cards.

10. A method of playing a wagering card game for a number of players, comprising the steps of:

providing a plurality of lower numerical ranking cards of one or more typical fifty-two card Poker decks;

each player placing a wager to participate in the game;

a dealer dealing five cards face down to each player;

giving each player an opportunity to examine the five cards dealt to that player;

each player discarding face up the highest numerical ranking card and at least two other cards and holding remaining cards from that players dealt cards;

determining a dealer two card hand score based on the ranked numerical value of two of said players discarded face up cards;

determining a player hand score for each player based on the ranked numerical value of the respective players said remaining cards; and resolving each players wagers based on the dealers two card hand score and the players respective score.

11. The method according to claim 10, wherein the at least two other cards discarded by the players comprises three cards and the quantity of remaining cards is one.

12. The method according to claim 10, wherein the at least two other cards discarded by the players comprises two cards and the quantity of remaining cards is two.

13. The method according to claim 10, wherein the dealer shows the dealers two card hand.

14. The method according to claim 10, wherein cards are dealt to player positions occupied by the respective players and to player positions not occupied by the players.

15. The method according to claim 14, wherein the dealer discards face up a card from the cards dealt to the player positions not occupied by the players and the dealers two card hand score is based on the ranked numerical value of two of said players discarded face up cards and said non occupied player position discarded face up cards.

16. The method according to claim 10, wherein the dealer indicates the dealers two card hand with two respective removable apparatuses.

17. A method of playing a wagering card game for a number of players, comprising the steps of:

providing a plurality of lower numerical ranking cards of one or more typical fifty-two card Poker decks;

each player wagering an initial one part wager to participate in the game;

a dealer dealing five face down cards to each player;

each player discarding the highest numerical ranking card and at least two additional cards from the cards dealt to the respective player, the remaining one or more cards of the respective players dealt cards constituting a players hand for each player;

building a two card hand for the dealer by selecting two of said discarded highest cards from said players discarded highest cards;

summing numerical values of the cards of the dealers two card hand and obtaining a dealer score using the ones position of said dealers summed values;

determining each players score by summing numerical values of the remaining one or more cards of the respective players hand and using the ones position of said respective players summed values;

resolving each players wagers on the basis of the dealers score and the respective players score, wherein a winning wager comprises a players score having a lower value than the dealers score.

18. The method according to claim 17, wherein the wagers are placed into one of two wager areas.

19. The method according to claim 17, wherein the at least two additional cards discarded by the players comprises three cards and the quantity of remaining one or more cards is one.

20. The method according to claim 17, wherein the at least two additional cards discarded by the players comprises two cards and the quantity of remaining one or more cards is two.

21. The method according to claim 17, wherein cards are dealt to player positions occupied by the respective players and to player positions not occupied by the players.

22. The method according to claim 21, wherein the dealer discards face up the highest numerical ranking card from the cards dealt to the player positions not occupied by the players and building the dealers two card hand by selecting two discarded highest cards from either of said players discarded highest cards or said non occupied player position discarded face up cards.

23. The method according to claim 17, wherein the dealer identifies each of said dealers selected highest cards with an indicator apparatus.

24. The method according to claim 17, wherein the dealer displays the dealers score using one or more dice.

25. The method according to claim 17, wherein the quantity of cards in each players hand equals the quantity of cards in the dealers hand.

26. The method according to claim 21, wherein the quantity of player positions is at least equal to the quantity of cards dealt to each said player position.

27. The method according to claim 17, wherein the quantity of players is less than eight.

28. The method according to claim 17, wherein for a number of players equal to seven, the plurality of lower numerical ranking cards of one or more typical fifty-two card Poker decks is at least thirty-five cards.

29. An apparatus for playing the wagering game of claim 17, said apparatus including a playing surface having a wagering receiving area for receiving the players wager, five player positions each depicted by an image, a player card receiving area depicted by the word HOLD for receiving and showing the remaining one or more cards of the respective players dealt cards, a card area depicted by the word HIGH for receiving the players discarded highest card, and a card area depicted by the word DISCARD for receiving and showing the players at least two additional discards.

30. An apparatus for playing the wagering game of claim 17, said apparatus including a playing surface having two wagering receiving areas for receiving each players wager, seven player positions each depicted by an image, a player card receiving area depicted by the word HOLD for receiving and showing the remaining one or more cards of the respective players dealt cards, a card receiving area depicted by the word HIGH for receiving the players discarded highest card, a card receiving area depicted by the word FOLD for receiving and showing the players at least two additional discards.

* * * * *